US006695145B2

(12) United States Patent
Veau

(10) Patent No.: US 6,695,145 B2
(45) Date of Patent: Feb. 24, 2004

(54) UNIQUE SEQUENCING AND SORTING SYSTEM FOR GARMENTS IN THE UNIFORM RENTAL BUSINESS

(76) Inventor: Frederic Veau, 27 Lantham La., Reading, MA (US) 01867

( * ) Notice: Subject to any disclaimer, the term of this patent is extended or adjusted under 35 U.S.C. 154(b) by 0 days.

(21) Appl. No.: 09/945,571

(22) Filed: Aug. 30, 2001

(65) Prior Publication Data

US 2002/0112994 A1 Aug. 22, 2002

Related U.S. Application Data

(60) Provisional application No. 60/270,389, filed on Feb. 21, 2001.

(51) Int. Cl.[7] ..... B07C 5/00
(52) U.S. Cl. ..... 209/3.3; 209/583
(58) Field of Search ..... 209/933, 937, 209/2, 3.3, 539, 583

(56) References Cited

U.S. PATENT DOCUMENTS

| | | | | |
|---|---|---|---|---|
| 1,808,406 A | * | 6/1931 | Gammell | 209/3.3 |
| 1,813,229 A | * | 7/1931 | Constable | 209/705 |
| 3,780,543 A | * | 12/1973 | Rosenfeld et al. | 68/18 F |
| 4,239,435 A | | 12/1980 | Weiss et al. | |
| 4,991,719 A | | 2/1991 | Butcher et al. | |
| 5,072,822 A | | 12/1991 | Smith | |
| 5,220,511 A | | 6/1993 | Speckhart et al. | |
| 5,377,814 A | * | 1/1995 | Smith et al. | 198/465.4 |
| 5,388,703 A | | 2/1995 | Schonenberger et al. | |
| 5,419,439 A | | 5/1995 | Branch | |
| 5,441,158 A | | 8/1995 | Skinner | |
| 5,687,850 A | | 11/1997 | Speckhart et al. | |
| 5,799,800 A | * | 9/1998 | Lux | 209/559 |
| 6,010,239 A | | 1/2000 | Hardgrave et al. | |
| 6,050,421 A | | 4/2000 | Hansen et al. | |

OTHER PUBLICATIONS

Lorie Damon—Managing Editor—"Old Garment Control Technology May Last Forever"—Industrial Launderer—Aug. 2000, vol. 51 No. 8,p. 51 Kenneth Koepper, Publisher—Arlington, VA U.S.A.

ChronoLogic Corporation Advertisement Textile Rental Magazine vol. 84, No. 1 Sep. 2000 p. 110.

* cited by examiner

*Primary Examiner*—Donald P. Walsh
*Assistant Examiner*—Joseph C Rodriquez
(74) *Attorney, Agent, or Firm*—Randall L. Reed, Esq.; Levin & Hawes, LLP

(57) ABSTRACT

A method for organizing the picking up of soiled garments, cleaning them and returning of them to a customer is disclosed that greatly improves the efficiency and speed of current methods by retaining the garments of a specific route together in an identifiable collection and working in a just in time flow. Upon the arrival of the soiled garments at the cleaning plant, garments from each route are cleaned and dried in identifiable collections according to the route on which the garments were picked up. The garments are then sorted by customer on each route and wearer at each customer at which point the garments are ready for return to the customer.

7 Claims, 3 Drawing Sheets

UNIQUE SEQUENCING AND SORTING SYSTEM FOR GARMENTS IN THE UNIFORM RENTAL BUSINESS

This application claims priority of provisional patent application serial No. 60/270,389 filed on Feb. 21, 2001.

FIELD OF THE INVENTION

The present invention relates to the garment rental business. More particularly it relates to a system and method of streamlining the cleaning, sorting and return process of a uniform rental operation.

BACKGROUND OF THE INVENTION

The uniform rental business is a substantial industry that provides a product and service for many companies that use uniforms. Restaurants, manufacturing companies, research or analysis laboratories, repair service companies and a wide variety of other companies are among those companies that require some or all of their employees to ware a uniform for safety, image or any number of other reasons. Many companies pay for the cost of the uniforms or special garments they require their employees to wear. For companies that do supply the uniform or garments for their employees the almost universal practice is to contract with a company that specializes in the uniform rental business. Such companies not only supply the necessary uniforms made and designed pursuant to the specifications of the employer but they also periodically pick up the soiled uniforms from the employer, clean the uniforms and return them to the employer on a periodic basis, such as every week etc. A profitable uniform rental business requires a substantial operation that handles a large number of customers (companies that require employees to wear uniforms) to be profitable. Generally, the customers are located over a fairly wide geographical area that requires multiple pick up and delivery routes. Additionally, each customer can have from several to hundreds of employees (wearers) who must wear the required uniform.

FIG. 1 is a schematic diagram that depicts the current state of the art in use in the uniform rental business for the process of cleaning and returning rental uniforms to customers. In the current practice companies that rent and clean a large number of uniforms or work related garments for various customers combined all of the garments together from various sources, i.e., customers and routes, and clean them together upon their arrival from the various routes 23. The dirty garments, when they first arrive, are sorted, generally according to type of textile and dirt or soiling the garments had on them 25. The purpose for doing this is to wash the garments according to the type of textile and soil or dirt the garment has on it. This is due to the fact that the type of soil or dirt on the garment may dictate the type of cleaning process necessary.

After the garments were cleaned, they then were sent on to the "tunnel or presses" 27 for a drying and finishing process. In the tunnel the garments are dried by heat and blown air in such a fashion that most the wrinkles fall out of the garments. Upon leaving the tunnel or presses the garments are then sent through a two-step sorting process (some times three steps) to reassemble the garments by routes and customers on each route for redelivery to the customer. This process generally takes two days, a day being needed for each sorting step. The first sorting step 31 involves sorting the garments according to their routes. Each garment will typically have a tag, not shown, which identifies the customer and wearer from which the route can be determined. The tag can alternatively have the route identification on it. At the first sort stage a person will usually visually inspect the tag 33 and then place it in the rack of the correct route 35. At the second sort step 37 each routes garments are then be sorted according to customers on that route and wearers at each customer. Some operations might break the second sort into a second sort by customer on each route and then a third sort by wearer at each customer.

Whether this two or three step sorting process is done by hand or is partially or fully automated using bar codes, radio frequency identification tags on the garments or some other identification system, the process is expensive and time consuming. In fact such a process can add up to a day or more to the cleaning and return process.

Thus, what is needed is a system and method for streamlining the sorting and returning process for the uniform rental business; a system that can be implemented within the context of a wide variety of current uniform rental cleaning and return operations without the need for expensive equipment upgrades or new equipment.

SUMMARY

It is an object of the present invention to provide an efficient and expeditious method for a commercial laundry operation to clean rented uniforms or work related garments for a large number of customers. It is a further object of the present invention to provide a method that can be easily integrated into the operation of a commercial laundry or uniform rental operation in an efficient, timely and cost effective manner.

The present invention accomplishes these and other objectives by providing a method for sorting and sequencing of garments in a just in time flow (no buffer or backlog allowed) from a multitude of sources, located on a plurality of routes, for cleaning and return to the original source of each specific garment collected, the method having the steps of: collecting a multitude of garments from a multitude of sources along a plurality of routes; cleaning the garments while retaining them in identifiable collections; putting the garments through a drying process sequenced according to their specific routes; sorting each routes garments by customer and wearer upon completion of the drying process; and wherein since the integrity of an identifiable group of garments from each specific route has been maintained all of the garments from a specific route can be quickly reassembled according to their specific route at any point during the process and thereby eliminate the need for sorting individual garments on a route by route basis.

In a further aspect of this invention it provides a method with the additional steps of sorting the garments according to type of soil on each garment for a cleaning process designed to clean that type of soil from the garment; segregating into retained identifiable collections during the sorting step garments from each specific route for cleaning according to type of soil; and cleaning according to type of soil the garments from several different routes together in their retained identifiable collections by route so that garments form each of the routes do not become mixed with garments from other routes.

BRIEF DESCRIPTION OF THE DRAWINGS

The invention will be better understood by an examination of the following description, together with the accompanying drawings, in which.

DETAILED DESCRIPTION OF THE PREFERRED EMBODIMENT

In a uniform rental business according to the present invention a driver delivers clean garments to various customers and picks up dirty garments on a periodic schedule. Usually, the routes are step up so that each customer is visited once each week, generally on the same day, by a driver for the exchange of clean garments for dirty garments. A route will be made up of several customers, on average 35. Each customer will be made up of several wearers, depending on the size of the customer, for a small company this could be less than ten wearers on the other hand for a large customer this could be several hundred wearers. Each identified wearer might have 11 shirts and pants. Each garment would have an identification tag with information such as customer number and/or name, wearer number and/or name, or any other information deemed necessary to facilitate the pick up, cleaning, sorting and delivery of clean garments back to the customer. The tags, in the preferred embodiment would have the information in human readable form as well as some type of coding system such as a bar code etc. that is machine-readable, i.e. optical scanner the can read bar code etc.

The system of present invention provides for the washing of the garments route by route as they arrive and keeps the garments from a specific route together as they come out of the washroom and into the Tunnel or the presses after the cleaning process. The Tunnel puts the garments thorough a combined heat and blow dry drying process designed to dry and remove wrinkles from the garments. Upon leaving the Tunnel or the presses the garments are sorted by customer and wearer at the same time. Damaged garments are then mended and the garments are assembled for delivery by route. The whole process can take only a matter of hours. The system can also accommodate the inclusion of late garments.

Figure 1:
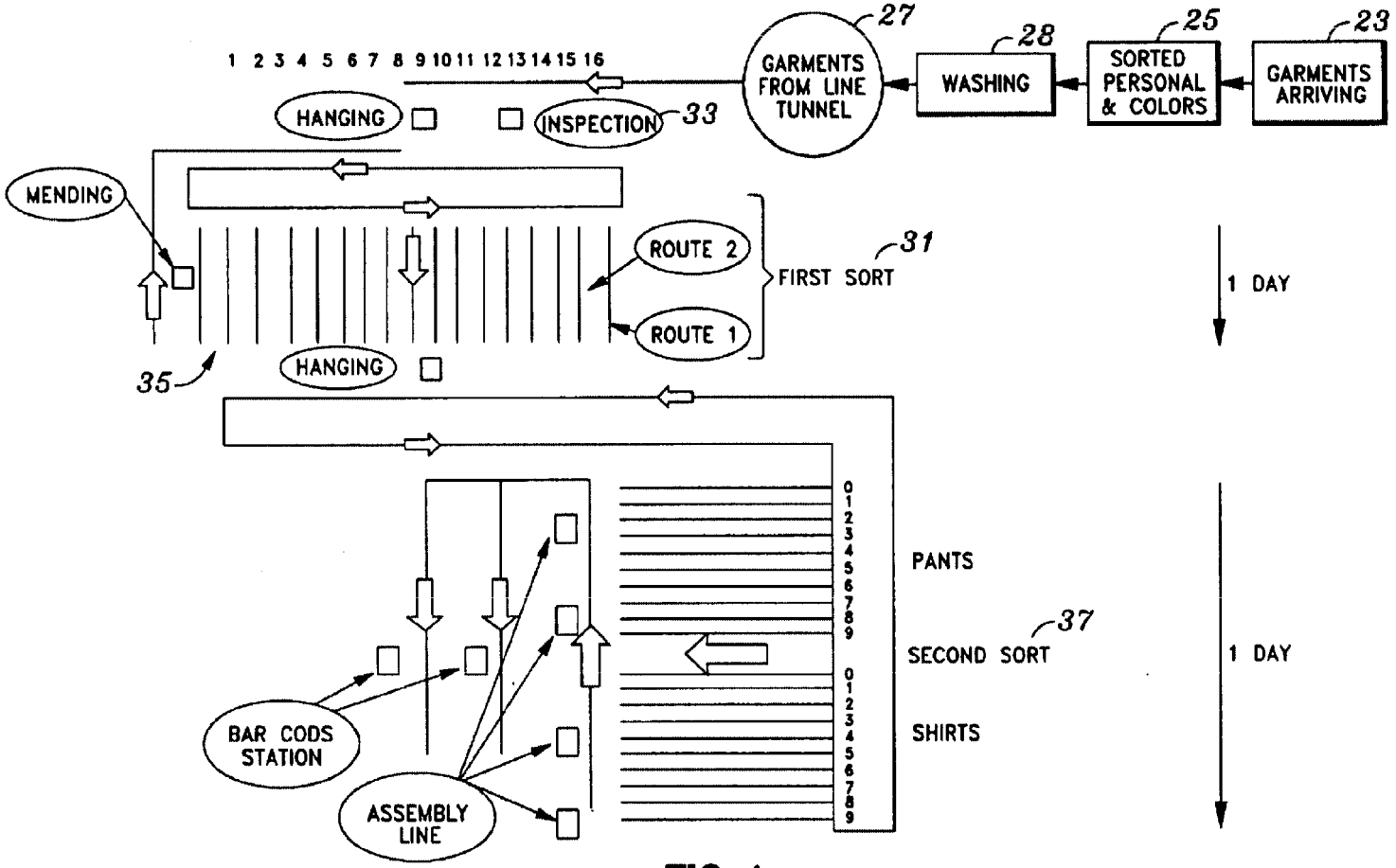
FIG. 1 (PRIOR ART)
FIG. 1 is a schematic diagram of a prior art uniform rental cleaning, sorting and return operation.
Figure 2:
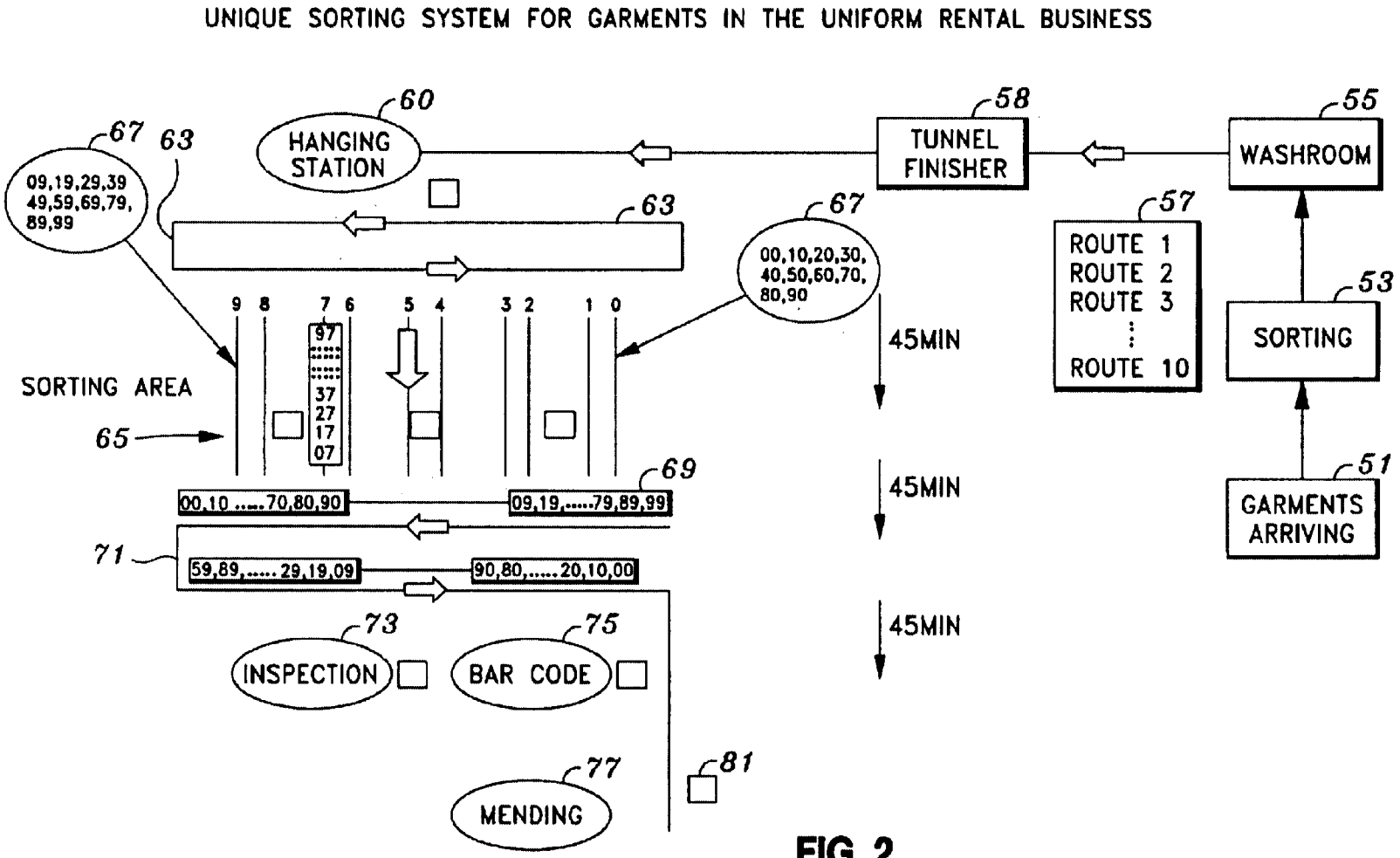
FIG. 2 is a schematic diagram of a uniform rental cleaning, sorting and return operation according to a preferred embodiment of the present invention.

FIG. 2 is a schematic diagram of the process of the present invention. Upon arrival at the cleaning plant 51, the garments in a preferred embodiment are sorted according to textile and soil or dirt for the purpose of washing 53. However, garments from the same route are kept together and segregated from the garments of another route. Ideally the garments from one route are cleaned together in the same washing process. If the type of textile requires a separate type of cleaning process, garments from the same route that require the specific cleaning process, are placed in a special mesh bag that allows the cleaning liquid to flow through the bag and wash the garments in the bag but keeps the contents of the bag together. Thus, garments from several routes can be cleaned together in the same cleaning process without losing the integrity of their groupings by their routes.

Once the cleaning process is complete the garments grouped together with their particular route are then sent through the "Tunnel or the presses" 58. The process in the Tunnel 58 as noted above dries and helps remove wrinkles from the garments. Upon reaching the end of tunnel the garments arrive at the hanging station 60. The garments arrive at hanging station 60 grouped in their routes.

From the hanging station they move by conveyor 63 onto the sorting area 65 where the garments are sorted by customer number and wearer number of each customer. This is possible since the garments are already grouped together by their respective routes. Sorting of the garments in the preferred embodiment is done, in a just in time flow, by customer numbers 67 instead of route number since they are already segregated into their respective routes. The sorting area (65) is not use as a storage area anymore, but rather as a processing station in which the garments pass rapidly through, as in they do in the tunnel.

From the sorting station the garments move onto a final inspection station 73 and a bar code station 73, and optional step. At this stage damaged garments in need mending 77 are fixed. At the bar code station the orders are reviewed to determine if they are in proper order.

In the system of the present invention completing the passage from the hanging station 60 to the sorting area can take less than 45 minutes per route. Similarly passage through the sorting area can take no more than 45 minutes. Finally, passage through the final inspection station can take no more than 45 minutes and thus the garments sorted and packaged by each route arrive at the final loading station 81 in no more than 2 hours and 15 minutes after leaving the tunnel. This results in a much more efficient operation than allowed by existing practices which require an initial sorting of the garments by route.

Figure 3:
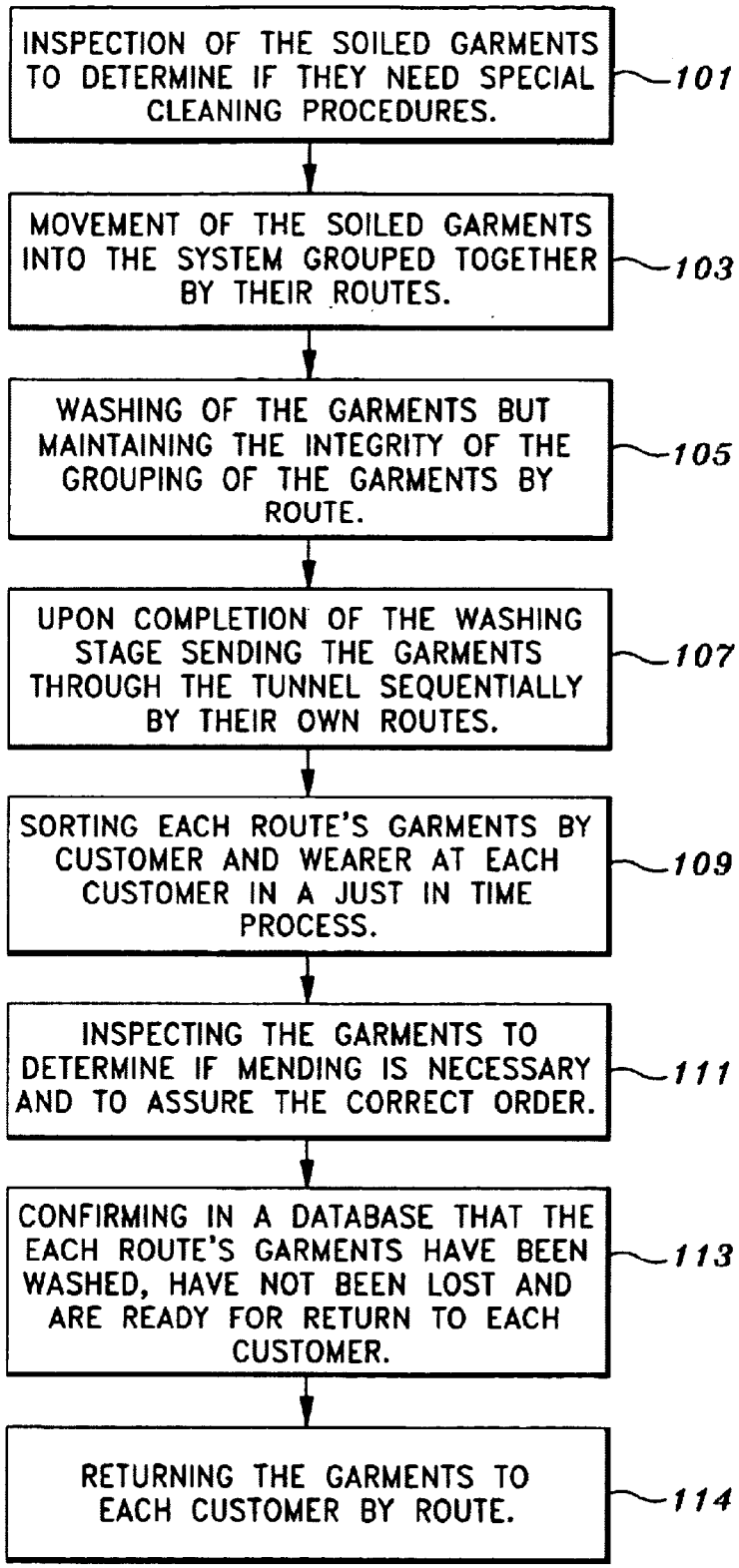
FIG. 3 is flow chart of the process of a preferred embodiment of the present invention.

A flow chart of the major operational steps of the present invention is set forth in FIG. 3. The soiled garments arrival grouped together by routes, this is due to the fact that they arrive at the cleaning plant on each respective routes pickup truck. However, the garments from each route are kept together in their respective routes grouping. The soiled garments are then inspected by the drivers to determine if they need special cleaning procedures 101. The garments move into the system grouped together by their routes 103. When the garments are washed they are washed so that the integrity of the grouping of the garments by route is maintained 105. The integrity of the grouping of the garments by route can be maintained by washing the garments from one route together as in their own batches. If special washing procedures are required for some of the garments from a route they can be washed with garments from another route by placing the garments from each route in their own mesh bag (a mesh type of garment bag that allows the cleaning fluid to freely mix with the garments during the cleaning process but yet retains the garments in retained identifiable collections for each route cleaned together). Upon completion of the washing stage the garments are sent through the Tunnel sequentially together with the other garments from the same route 107. The next step is sorting each route's garments by customer and wearer at each customer 109. The garments are then inspected to determine if mending is necessary and to assure the garments are in the correct order 111. The next step is confirming each route's garments have been washed, have not been lost and are ready for return to each customer and confirming this by an appropriate database entry 113. This step of verifying that a customer's garments are accounted for and clean is of particular importance from the customer service point of view. In a preferred embodiment entry of the information into a database would be accomplished by an automatic data entry system such as one that uses bar codes and laser readers as discussed above. Naturally, a computer system with appropriate software and database would be used. Such information would facilitate billing of customers. The final step is return of the clean garments to each customer by route 114.

Elimination of the one or two extra steps currently in use in conventional methods is quite significant whether or not the system is fully or partially automated or simply done manually. Naturally, if it is a wholly manual operation eliminating the step eliminates a significant labor overhead cost. Also, in a fully or semi-automated system elimination of the step not only eliminates costly machinery required for the additional sorting step it also eliminates the need to repair such machinery. Since the system and method of the present invention substantially reduces they complexity of the operation and presents a large space saving, it can be more easily integrated into current operations with a minimal investment and without the need for costly changes to existing plant and equipment.

As noted above the present invention saves time since it highly efficient and allows the completion of the cleaning and sorting process to a day at most. If the operation is working on a one-week cycle, i.e. clean uniforms are delivered and dirty ones picked up every week from each customer than the work cleaning and sorting of the garments for delivery back to the customer is accomplished at least four working days in advance of the delivery date. Since the system is simpler to operate it is much easier to supervise operation and control the workflow. Also, by simplifying the operation with the present invention the chances of problems, such as lost garments etc. are substantially reduced. All of these advantages add up to better customer satisfaction.

While the invention has been particularly shown and described with reference to a preferred embodiment thereof, it will be understood by those skilled in the art that various changes in form and detail may be made to it without departing from the spirit and scope of the invention.

I claim:

1. A method for sorting and sequencing of garments from a multitude of sources, located on a plurality of routes, for cleaning and return to the original source of each specific garment collected, the method comprising the steps of:

a) collecting a multitude of garments from a multitude of sources along a plurality of routes;

b) cleaning the garments while retaining them in identifiable collections of garments wherein the garments are not on hangers while being cleaned:

c) putting the garments through a drying process sequenced according to their specific routes;

d) sorting in a just in time flow each route's garments by customer and wearer upon completion of the drying process; and e) wherein since the identifiable collections of garments from each specific route has been maintained all of the garments from a specific route are quickly reassembled according to their specific route at any point during the process and thereby eliminate the need for sorting individual garments on a route by route basis.

2. The method of claim 1 wherein the cleaning step further includes:

a) sorting the garments according to type of textile and soil on each garment for a cleaning process designed to clean that type of soil from the garment;

b) segregating into retained identifiable collections during the sorting step garments from each specific route for cleaning according to type of soil; and c) cleaning according to type of soil the garments from several different routes together in their retained identifiable collections so that they do not become mixed with garments from other routes.

3. The method of claim 1 including the further step of verifying that a customer's garments are accounted for and cleaned.

4. The method of claim 2 wherein the step of cleaning garments from several routes together in their retained identifiable collections comprises in part the step of placing the garments from each route together in their own sling.

5. A method for sorting and sequencing of garments from a multitude of sources, located on a plurality of routes, for cleaning and return to the original source of each specific garment collected, the method comprising the steps of:

a) collecting a multitude of garments from a multitude of sources along a plurality of routes;

b) sorting the garments according to type of textile and soil on each garment for a cleaning process designed to clean that type of soil from the garment;

c) segregating into retained identifiable collections during the sorting step garments from each specific route for cleaning according to type of soil; and d) cleaning according to type of soil the garments from several different routes together in their retained identifiable collections so that they do not become mixed with garments from other routes;

e) putting the garments through a drying process sequenced according to their specific routes;

f) sorting in a just in time flow each route's garments by customer and wearer upon completion of the drying process; and g) wherein since the identifiable collections of garments from each specific route has been maintained all of the garments from a specific route are quickly reassembled according to their specific route at any point during the process and thereby eliminate the need for sorting individual garments on a route by route basis.

6. The method of claim 5 including the further step of verifying that a customer's garments are accounted for and cleaned.

7. The method of claim 5 wherein the step of cleaning garments from several routes together in their retained identifiable collections comprises in part the step of placing the garments from each route together in their own sling.

* * * * *